US005369965A

United States Patent [19]

Shima et al.

[11] Patent Number: 5,369,965

[45] Date of Patent: * Dec. 6, 1994

[54] UPPER NEEDLE BED SUPPORT FOR V-BED KNITTING MACHINE

[75] Inventors: Masahiro Shima; Masahiro Yabuta; Toshinori Nakamori; Minoru Sonomura, all of Wakayama, Japan

[73] Assignee: Shima Seiki Mfg. Ltd., Wakayama, Japan

[ * ] Notice: The portion of the term of this patent subsequent to Apr. 26, 2011 has been disclaimed.

[21] Appl. No.: 898,088

[22] Filed: Jun. 12, 1992

[30] Foreign Application Priority Data

Jun. 18, 1991 [JP] Japan ..... 3-173263
Aug. 23, 1991 [JP] Japan ..... 3-237247

[51] Int. Cl.[5] ..... D04B 7/04
[52] U.S. Cl. ..... 66/64; 66/60 R
[58] Field of Search ..... 66/64, 66, 72, 69, 62, 66/60 R

[56] References Cited

U.S. PATENT DOCUMENTS 750,052 1/1904 Gréaud ..... 66/63
4,100,766 7/1978 Kuhnert ..... 66/62
4,905,483 3/1990 Shima ..... 66/64

FOREIGN PATENT DOCUMENTS 2511086 9/1976 Germany ..... 66/64
26249 12/1905 United Kingdom ..... 66/64

*Primary Examiner*—Clifford D. Crowder
*Assistant Examiner*—Larry D. Worrell, Jr.
*Attorney, Agent, or Firm*—Barnes, Kisselle, Raisch, Choate, Whittemore & Hulbert

[57] ABSTRACT

In a needle bed in which plural rows of needle plate grooves are provided in a lower needle bed base, lower needle plates are inserted into the needle plate grooves, and a lower needle groove is formed between the lower needle plates, wherein a part of the lower needle plates is extended upwardly, the extended portion serves as an upper needle bed supporting member, a fixing member for stopping an upper needle bed base is provided on the upper needle bed supporting member, and an upper needle bed base is supported above the lower needle bed by the upper needle bed supporting member.

5 Claims, 16 Drawing Sheets

UPPER NEEDLE BED SUPPORT FOR V-BED KNITTING MACHINE

BACKGROUND OF THE INVENTION

1. Field of the Invention

The present invention relates to a double V bed knitting machine in which a pair of upper needle beds having extreme ends opposed are provided on a pair of lower needle beds where extreme ends of the upper and lower needle beds are angularly opposed;

2. Prior Art

A V bed knitting machine has been known in which a pair of angularly opposed upper needle beds are provided above a pair of lower needle beds having heads opposed in angle. In this V bed knitting machine, an upper bed is supported on a lower bed symmetrically to left and right, and the lower bed is mounted and supported at both left and right ends on the frame so as not to impede a reciprocating movement of a carriage which supports a lock for operating a needle of the lower bed. Therefore, it is expected that the needle bed is flexed downwardly in the central portion thereof, a tail of the needle bed lowers and an advancing direction of the needle is upwardly displaced. To cope with this, it is contemplated that a supporting member for the upper needle bed is provided on the carriage so that as the carriage moves, the needle bed is always maintained at a predetermined position through a roll provided on the supporting member.

However, in the aforementioned apparatus, a flexture of the upper needle bed is borne by the carriage, and the apparatus is not constructed so that no flexture occurs in the needle bed itself. The construction of the carriage is also complicated.

Furthermore, there is no proposal of an arrangement in which the upper needle bed itself is free from flexture nor proposal of accurately maintaining an angle formed by the upper and lower needle beds.

OBJECT AND SUMMARY OF THE INVENTION

It is an object of the present invention to provide a double V bed knitting machine in which a double needle bed comprises an upper needle bed placed above a lower needle bed where the upper needle bed is supported to prevent flexure at a central portion thereof.

It is another object of the present invention to provide a double V bed knitting machine which is free from flexture in the upper needle bed and can always maintain an angle formed by the upper and lower needle beds.

According to the present invention, in a needle bed in which plural rows of needle plate grooves are provided in a lower needle bed base, lower needle plates are inserted into said needle plate grooves, and a needle groove is formed between the lower needle plates, it is proposed a double V bed knitting machine wherein a part of said lower needle plates is extended upwardly, said extended portion serves as an upper needle bed supporting member, a fixing member for stopping an upper needle bed base is provided on the upper needle bed supporting member, and an upper needle bed base is supported above the lower needle bed by the upper needle bed supporting member.

In the lower needle plates fitted in the needle plate groove of the lower needle bed base, the needle groove of the lower needle bed is formed between the lower needle plates. The lower needle plate constitutes a side wall of the needle groove and extends upward, the extended portion serves as the base supporting member for the upper needle bed, and the upper needle bed base of the upper needle bed is supported by the supporting member and supported and fixed by the fixing member. More specifically, a dovetail formed by a wedge-like head and a wedge-like notch provided on the lower surface of the upper needle bed base is held by a notch provided in an upper edge of the needle plate and a wedge-like end of a stop member provided on the upper edge end of the needle plate, and the stop member is tightened by a tightening bolt whereby the needle plate and the upper needle bed base are integrally fixed. By this fixing, the upper needle bed base is supported by the lower needle plate from the bottom at predetermined intervals widthwise of knitting.

According to another embodiment of the present invention, needle plates are fitted in plural rows of needle plate grooves provided in a lower needle bed base, the needle plates are extended upwardly to form upper needle groove walls, a needle plate spacer is held between the upper needle groove walls, and an upper needle bed is constituted by the upper needle groove walls and the needle plate spacer.

A part of the needle plates fitted in the plural rows of needle plate grooves provided on the lower needle bed base to integrate the needle plates of the upper needle bed with the needle plates of the lower needle bed. Since the needle plate spacer is inserted between the needle plates of the upper bed, a spacing between the needle plates adjacent to each other is constant, and the upper surface of the needle plate spacer constitutes a bottom of the needle groove to receive a needle. Accordingly, the upper and lower needle beds are constructed to be integral and an angle formed therebetween is always constant.

DETAILED DESCRIPTION OF PREFERRED EMBODIMENT

One embodiment will be described below with reference to the drawings.

Figure 1:
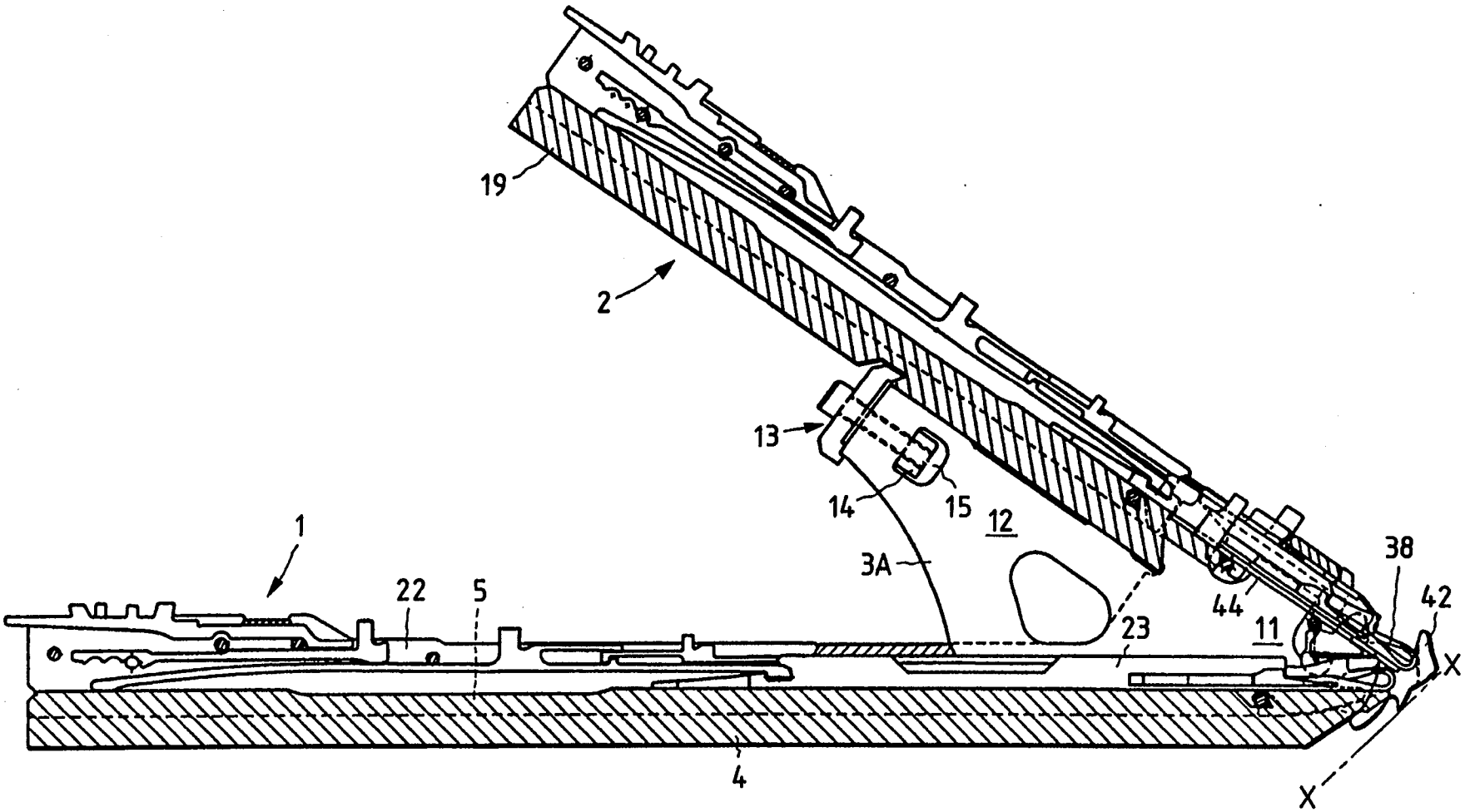
FIG. 1 is a schematic side view of the whole structure of one embodiment of the present invention, showing only one side of a center line.
Figure 2B:
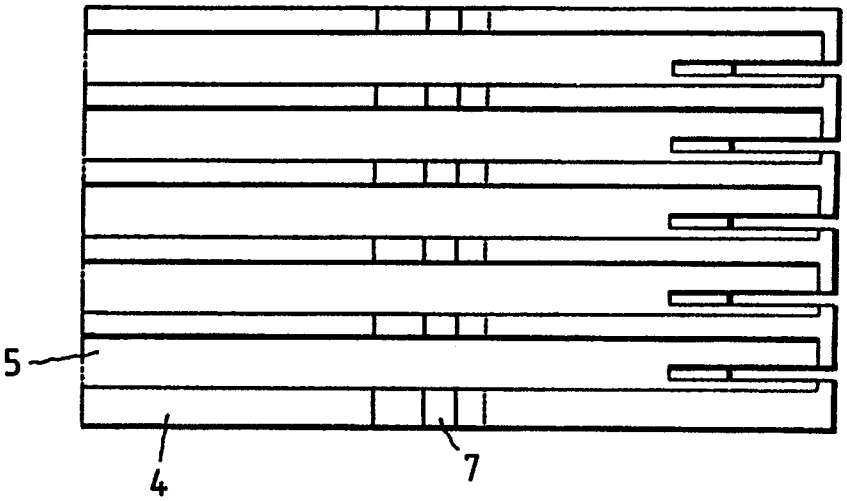
FIG. 2*a* and 2*b* show a lower needle bed base, FIG. 2*a* being a longitudinal side view, FIG. 2*b* being an enlarged plan view of a head.
Figure 2A:
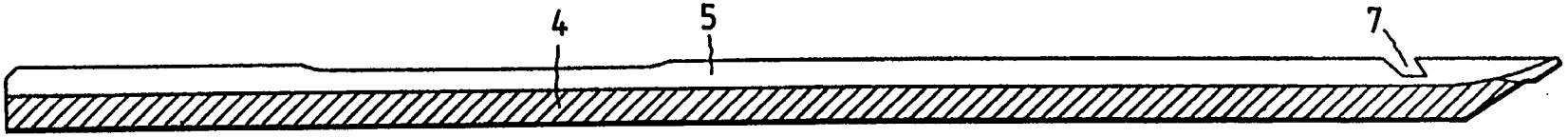

The knitting machine according to the present invention is a knitting machine of a 4-bed system in which an upper needle bed 2 is supported above a lower needle bed 1 having extreme ends opposed in angle. The machine is symmetrical to left and right about a center line X—X which passes through a tooth portion on which tops of the needle beds 1 and 2 are concentrated (see FIG. 1).

Figures 3A, 3B, 3C:
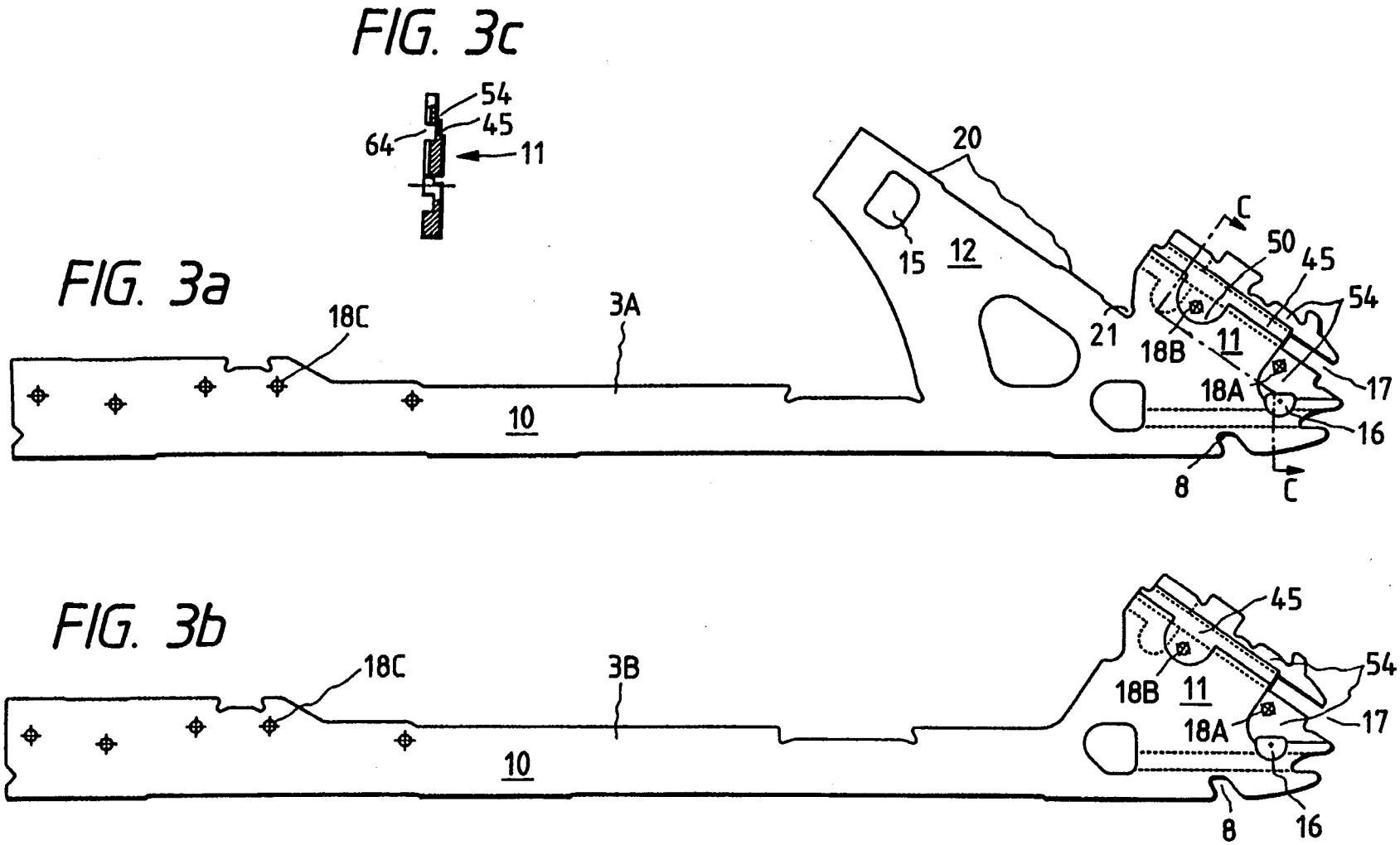
FIGS. 3*a*, 3*b* and 3*c* are a side view and a sectional view of a lower needle plate, FIG. 3*a* showing an example having an upper needle bed base supporting member, FIG. 3*b* showing an example having no upper needle bed base supporting member, and FIG. 3*c* being a sectional view taken on line C—C of FIG. 3*a*.

The upper needle bed 2 is supported by a lower needle plate 3A of the lower needle bed 1. A lower needle bed base 4 is provided with a plurality of needle plate grooves 5 similar to the conventional needle bed. Needle plates 3A and 3B are fitted in the lower portion of the groove 5, both of which are fixed, for example, by passing a wire 9 through notches 7 and 8 provided in the needle bed base 4 and the lower needle plates 3A and 3B, respectively. The lower needle plate 3A is a plate-like member composed of a lower needle guide portion 10 extending from a head to a tail of the lower needle bed 1, an upper needle supporting member 11 of an extended portion which extends above the head and an upper needle bed base supporting member 12 positioned on the upper edge of a rear needle plate, as shown in FIG. 3*a*, which has a fixed beam insert hole 15 for insertion of a fixed beam 14 of an upper needle bed fixing member later described, a sinker support hole 16, a needle blade guide groove 17, and wire insert holes 18A, 18B and 18C, etc. A supporting surface 20 for supporting an upper needle bed base 19 is obliquely provided on the upper needle bed base supporting member 12, and a wedge-like notch 21 is provided on the extension of the supporting surface 20. The lower needle plate 3B shown in FIG. 3*b* has a construction in which the upper needle bed base supporting member 12 of the extension portion which extends above the head in the lower needle plate 3A is removed.

The lower needle plates 3A and 3B are inserted into the needle plate groove 5 of the lower needle bed base 4 alternately or in a ratio of one needle plate 3A every two or three needle plates 3B, the lower needle bed base 4 and the needle plates 3A and 3B are fixed as previously mentioned, and a needle groove 22 is formed between the lower needle plates 3A and 3B. A lower needle 23 is slidably inserted into the needle groove 22.

The upper needle bed 2 is secured to the lower needle bed 1 by a fixing member in the procedure mentioned below. The fixing member 13 comprises engaging means comprising a wedge-like head 24 and a wedge-like notch 25 for engagement between the upper needle bed base 19 and the upper needle bed base supporting member 12 of the lower needle plate 3A, and stop and fixing means including a stopping member 26.

The upper needle bed base 19 is placed on the supporting surface 20 of the upper needle bed supporting member 12 of the lower needle plate 3A, and the wedge-like head 24 at the extreme end of the upper needle bed base 19 is placed in contact with the wedge-like notch 21 of the lower needle plate 3A. A notch 25 is provided at a position of the upper needle bed base 19 opposed to the end of the upper needle bed base supporting member 12, a wedge-like end 27 at one end of a wedge-like stopping member 26 extending widthwise of knitting of the knitting machine is brought into engagement with the notch 25, and the other end thereof is placed in contact with the upper needle bed base supporting member 12 of the lower needle plate 3A. A bolt 29 is threadedly engaged between the fixed beam 14 extending widthwise of the knitting beds inserted into the fixed beam insert hole 15 of the lower needle plate 3A and the stopping member 26, and the bolt 29 is tightened whereby a dove tail portion 30 between the wedge-like head 24 and the notch 25 of the upper needle bed base 19 is clamped by the wedge-like notch 21 of the lower needle plate 3A and the wedge-like end 27 of the stopping member 26 to secure the upper needle bed base 19 onto the lower needle plate 3A.

Figure 4B:
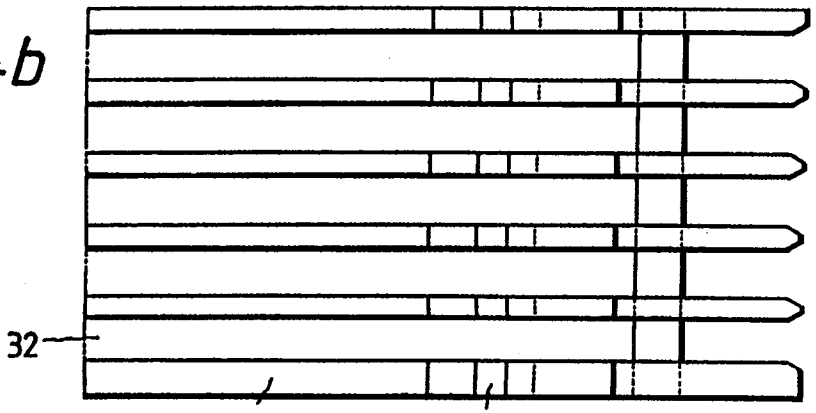
FIGS. 4*a* and 4*b* show an upper needle bed base, FIG. 4*a* being a longitudinal side view, and FIG. 4*b* being an enlarged plan view of a head.
Figure 4A:
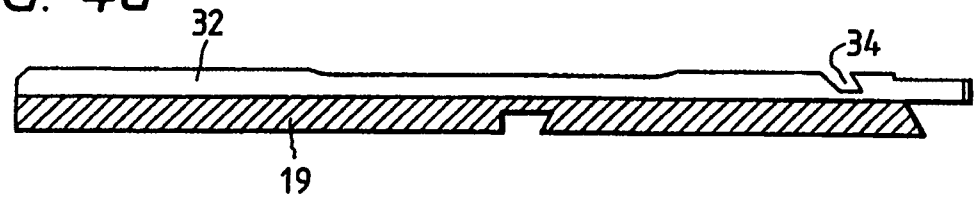
Figure 5B:
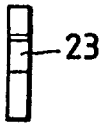
FIG. 5*b* is a front view of the same.
Figure 5A:
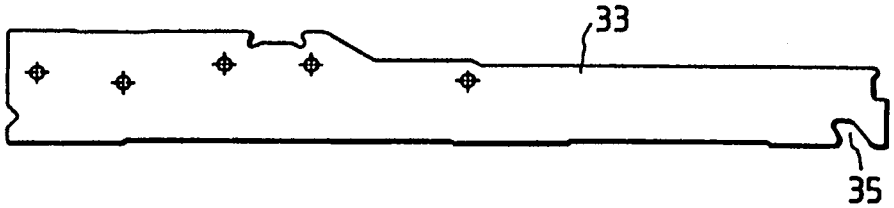
FIG. 5*a* is a side view of an upper needle plate.
Figure 6:
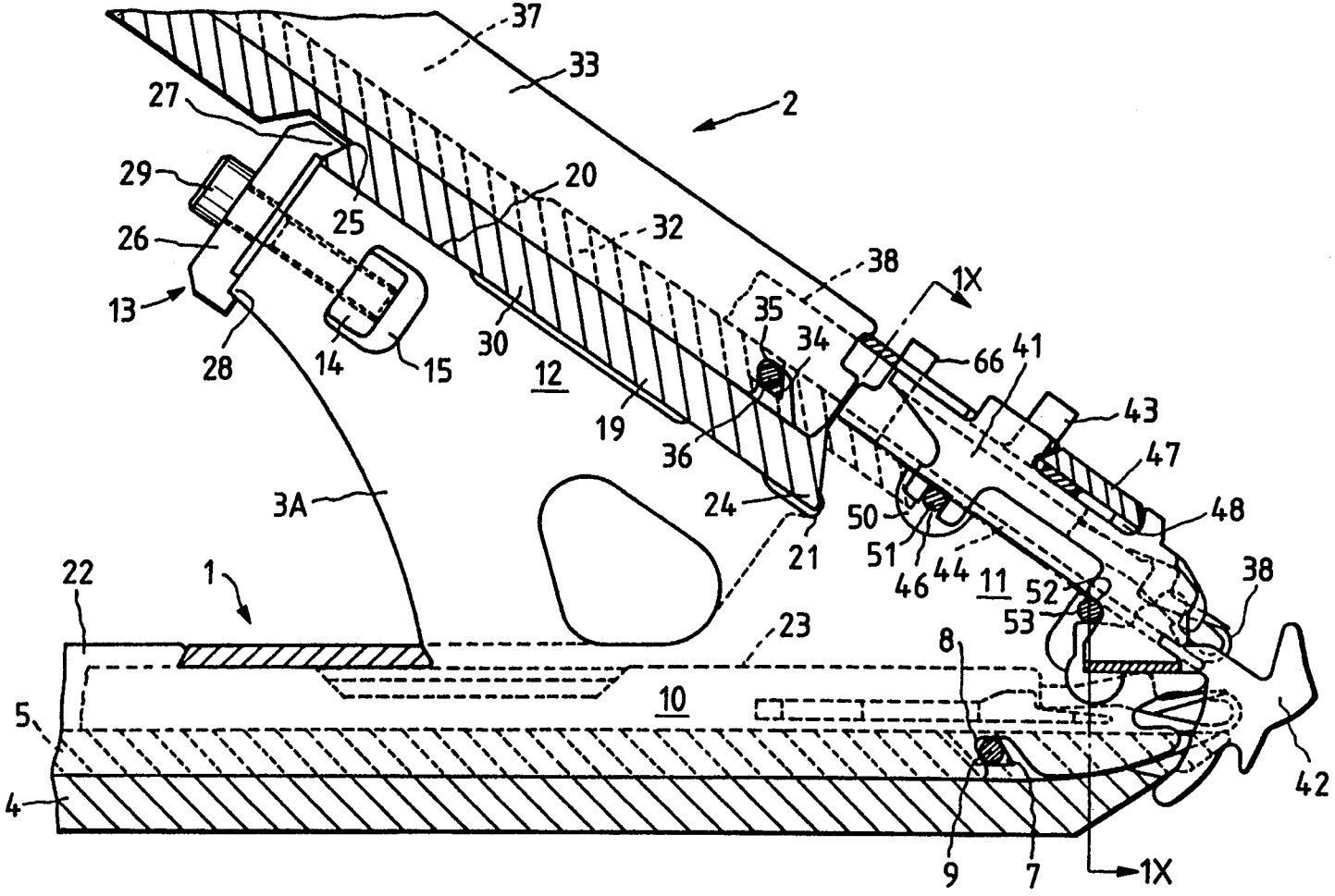
FIG. 6 is a sectional view taken on line VI—VI of FIG. 9.

The upper needle bed base 19 and the upper needle plate 33 are shown in FIG. 4 and FIG. 5, respectively. A needle plate groove 32 is provided in the upper needle bed base 19 in the same pitch and the same phase as that of the lower needle bed base 4, and an upper needle plate 33 is inserted therein.

They are fixed, for example, by passing a wire 36 between a notch 34 provided in an upper portion of the head of the upper needle bed base 19 and a notch 35 provided in a lower portion of the head of the upper needle plate 33. An upper needle groove 37 is formed between the upper needle plates 33 and 33 adjacent to each other, and an upper needle 38 is slidably inserted therein.

The upper needle supporting member 11 of the lower needle plates 3A and 3B has exactly the same shape. A sinker spacer 41, a sinker 42, a sinker jack 43, a knock over bit 44, etc. are provided on the upper needle supporting member 11. The details therefor will be described with reference to FIGS. 2, 3 and 6 to 13.

The sinker spacer 41 is located at a shoulder 45 provided on the upper needle supporting member of the lower needle plates 3A and 3B. The sinker spacer 41 (FIG. 12) has an inverted U-shaped wire insert notch 46 at a lower portion of the tail, an engaging recess 48 for inserting a strap 47 for fixing a needle plate spacer 67 at the upper edge, and a bent element 49 for keeping a lower needle 23 at the end edge extending downwardly of the head. The sinker spacer 41 has a wire insert notch 46 at the tail located at an enlarged shoulder 50 (FIGS. 3 and 6) of the upper needle supporting member 11 so that the notch 46 is brought into engagement with a wire 1 inserted into a wire insert hole 18B ranging the lower needle. Plates 3A and 3B. A depressed portion 52 at the lower part of the head is brought into engagement with a wire 52 similar to the former and secured to the upper needle supporting member 11.

Figure 7:
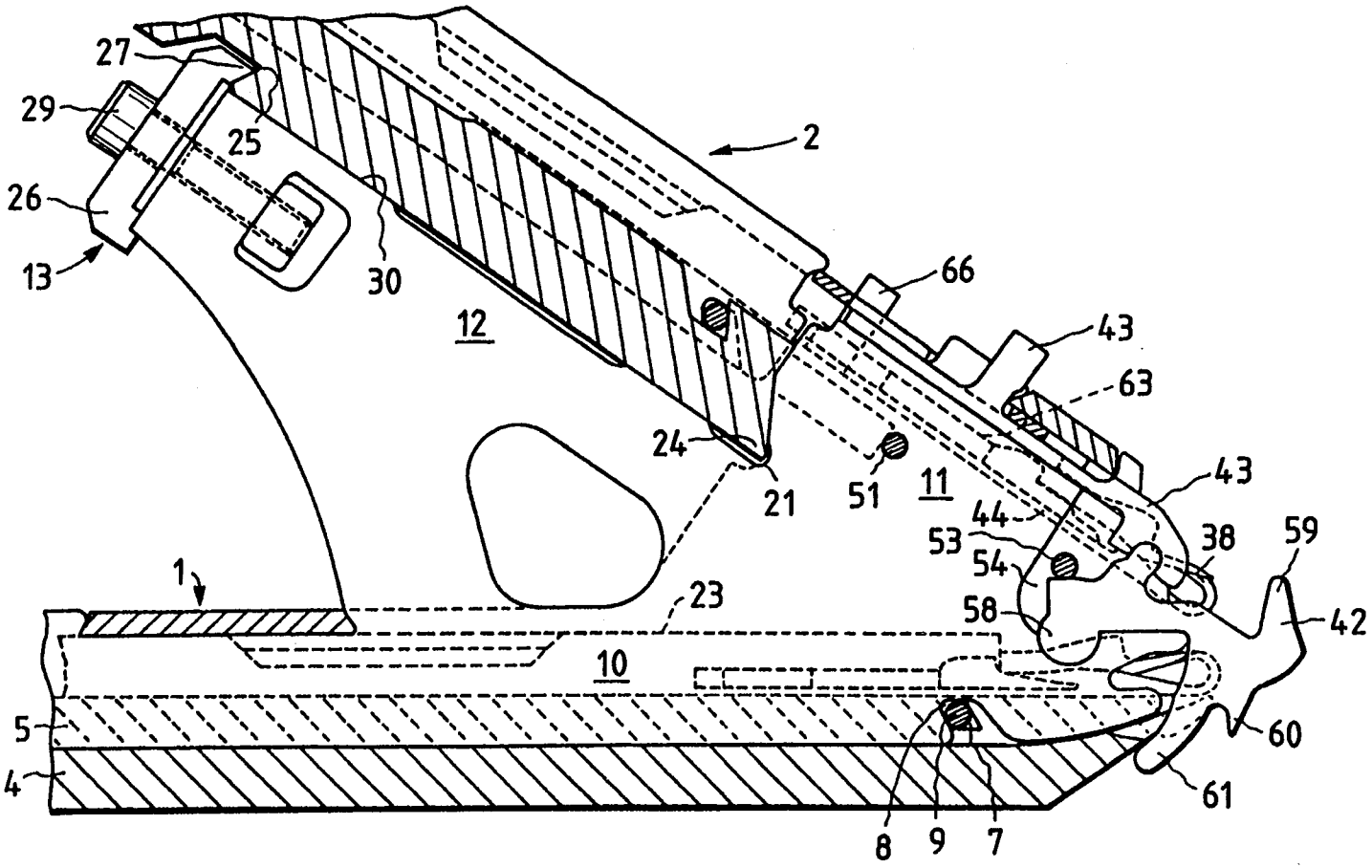
FIG. 7 is a sectional view taken on line VII—VII of FIG. 9.
Figure 8:
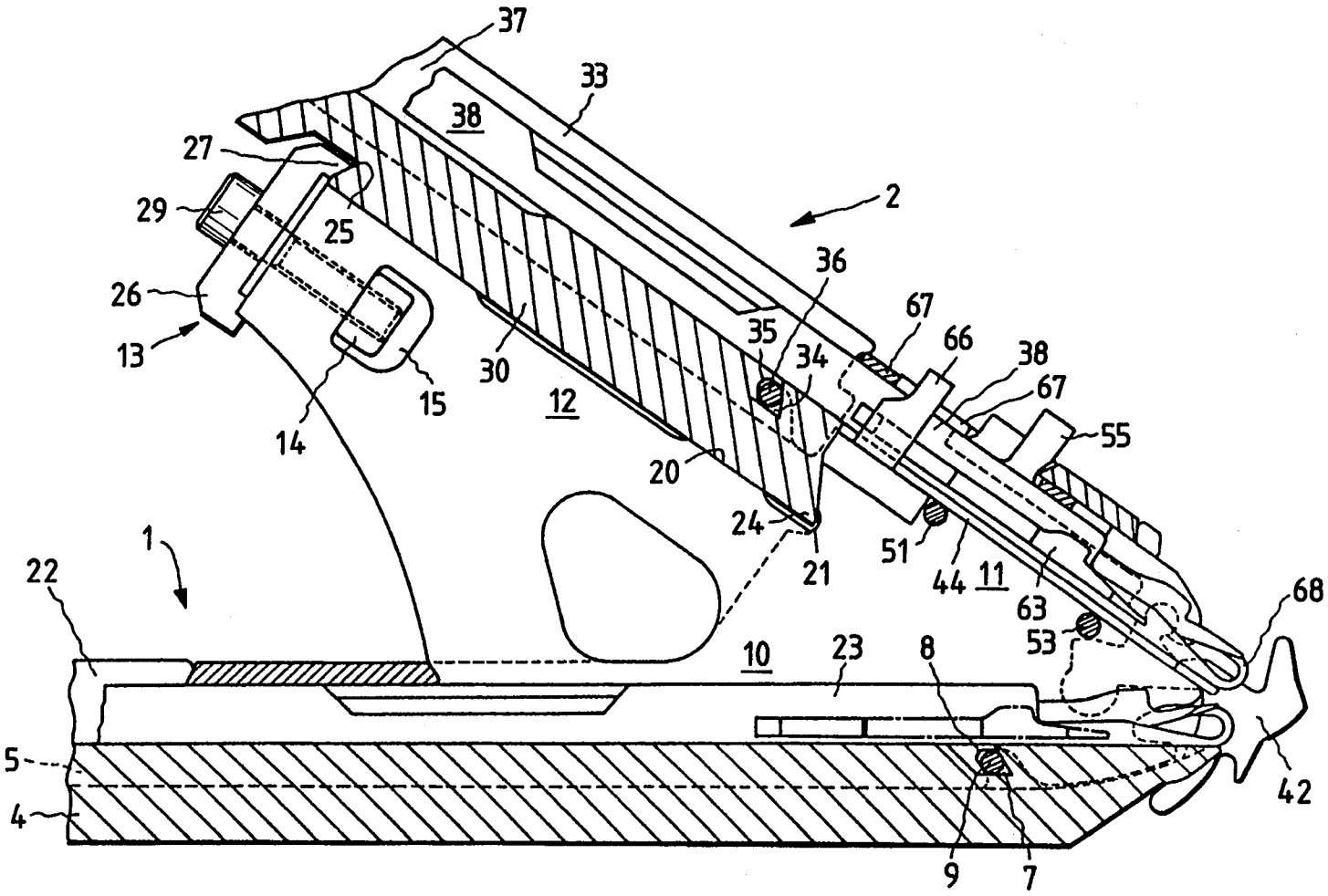
FIG. 8 is a sectional view taken on line VIII—VIII of FIG. 9.
Figure 9:
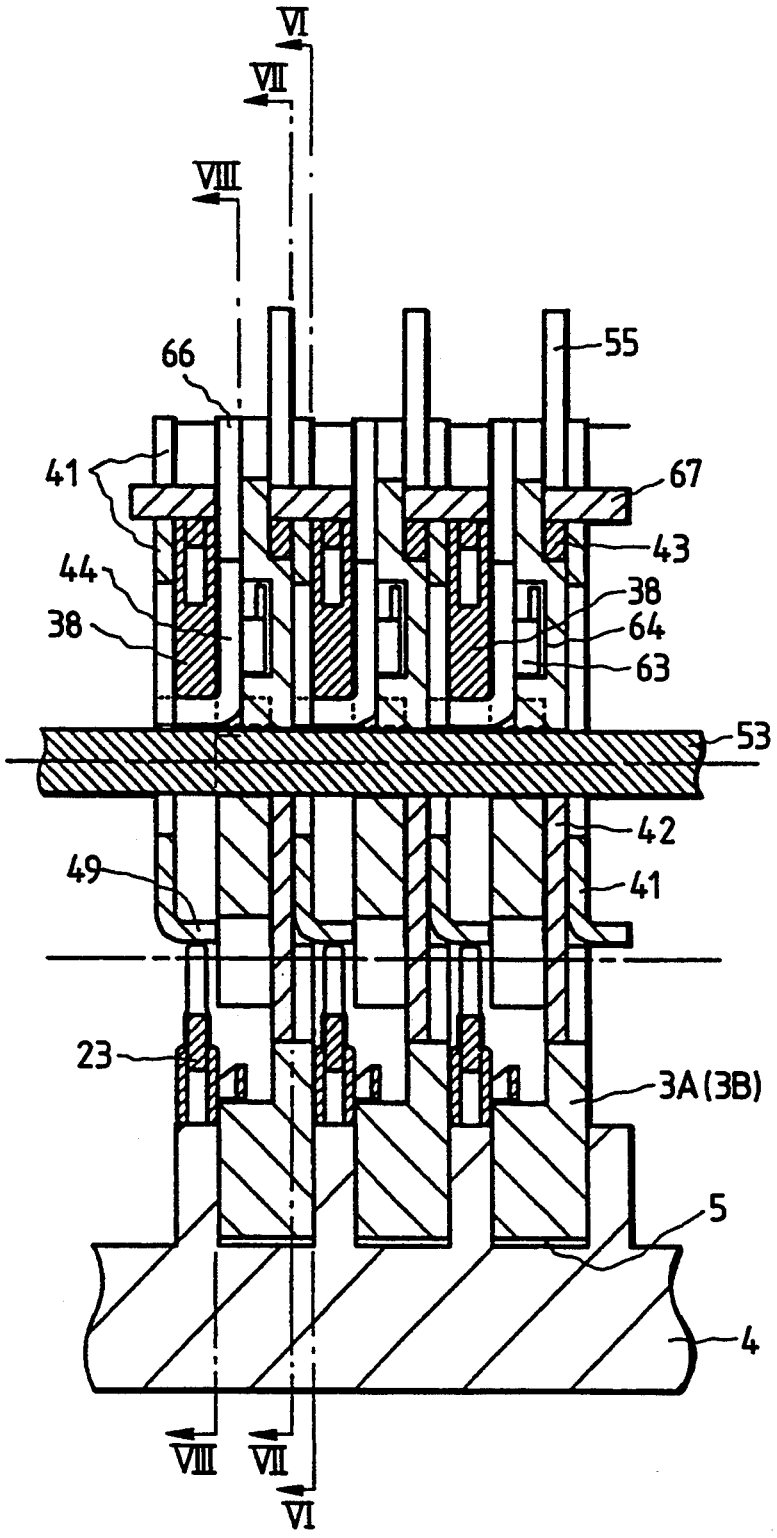
FIG. 9 is a sectional view taken on line IX—IX of FIG. 6.
Figure 10A:
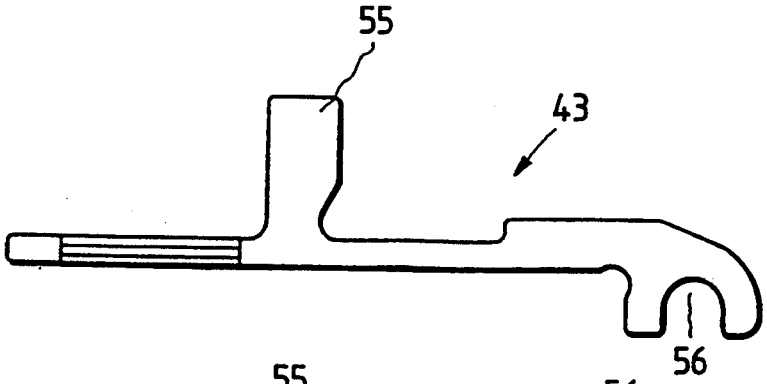
FIGS. 10*a* and 10*b* show a sinker jack, FIG. 10*a* being a side view, and FIG. 10*b* being a bottom view.
Figure 10B:
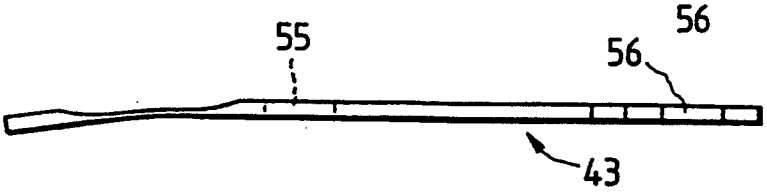
Figure 11:
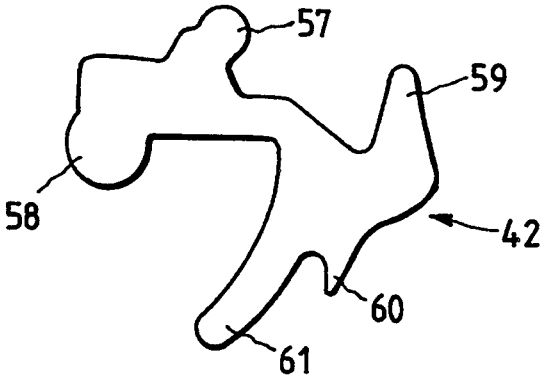
FIG. 11 is a side view of a sinker jack.
Figure 12:
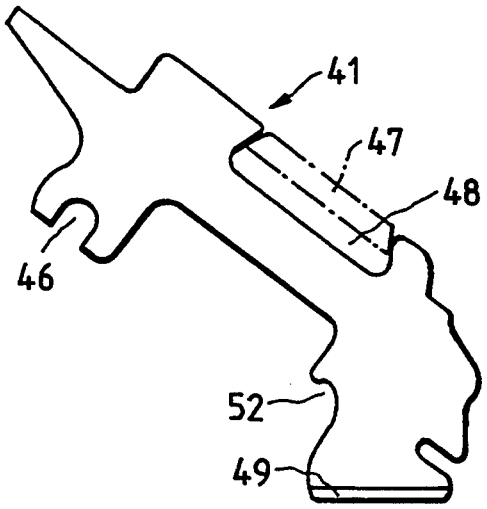
FIG. 12 is a side view of a sinker space.
Figure 13A:
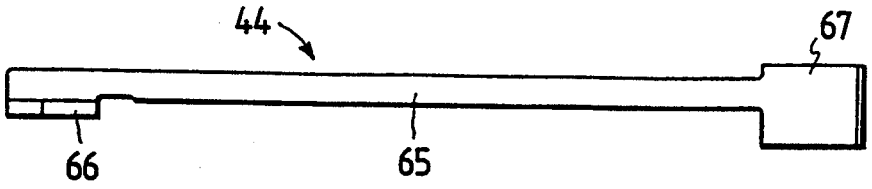
FIGS. 13*a*, 13*b* and 13*c* show a knockover bit, FIG. 13*a* being a plan view, FIG. 13*b* being a side view, and FIG. 13*c* being a back view.
Figure 13B:
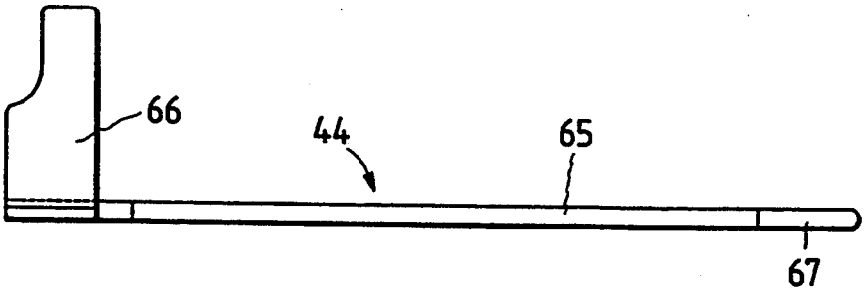
Figure 13C:
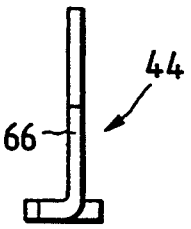

By securement of the sinker spacer 41 to the upper needle supporting member 11, a clearance is formed between the sinker spacer 41 and the top of the upper supporting member 11 by a top shoulder 54 (FIG. 3*c*) of the upper needle supporting member 11, and a sinker jack 43 is inserted therein (FIG. 7). The shoulder 54 is provided to be extended to the extreme end of the head of the lower needle plates 3A and 3B, and the sinker 42 is fitted in the extreme end portion of the head. The sinker jack 43 is in the form of an elongated plate as shown in FIG. 10, in which a thin portion in the vicinity of the tail is bent whereby when the sinker jack 43 is inserted into the clearance formed by the shoulder 54, it is not carelessly moved as a result of occurrence of sliding resistance. A butt 55 is formed at a head with a downward engaging recess 56. The engaging concave 56 is brought into engagement with an engaging convex 57 provided on the upper edge of the sinker 42. Similar to the sinker jack 43, the sinker 42 is also inserted into the same clearance formed by the shoulder 54 at the extreme end of the head of the lower needle plates 3A and 3B, and a rocking shaft 58 provided on the tail is fitted in a sinker supporting hole 16 provided in the head of the lower needle plates 3A and 3B and bored in contact with a shoulder at the extreme end of the head continuous to a top shoulder 54 so that the sinker 42 is rockably supported. The sinker 42 has angular portions 59, 60 and 61 in contact with a sinker loop vertically of the head.

On the side of the upper needle supporting member 11 opposite to the shoulder 15 is provided a guide recess 64 in which a loop transfer blade 63 of the upper needle 38 is moved and slidably moved, and a knockover bit 44 is slidably provided on the side of the guide recess 64 while being placed on the wires 51 and 53. The knockover bit 44 is provided a butt 66 at a tail of a flat-plate like shank 65 on which the upper needle 38 is placed and a square loop keep 67 at the head. A hook 68 of the upper needle 38 is located above the loop keep 67. A cam of a carriage not shown is placed in contact with the butt 66 of the knockover bit 44 so that it may be moved forward and backward along the upper needle 38. The butt 66 of the knockover bit 44 and the butt 55 of the sinker jack 43 are fitted into the clearance of the upper needle supporting member 11 with comb-like needle plate spacers 67 juxtaposed so that the positions thereof can be held accurately to maintain the spacing accurately.

In knitting operation of the knitting machine according to the present invention, the needles of the beds 1 and 2 are operated by cams (not shown) on the carriages corresponding to the lower needle bed 1 and the upper needle bed 2, respectively, and in the upper needle bed 2, the knockover bit 44 is moved forward and backward together with the upper needle 38 according to the operation of the lower needle to prevent the lower needle 22 from being impaired in forward and backward movement.

According to this embodiment of the present invention, the needle plates are inserted into plural rows of needle plate grooves provided in the lower needle head base, and the needle groove is formed between the needle plates to form the needle bed, in which a part of the lower needle plate is extended upwardly, said extended portion serves as the upper needle bed supporting member, the fixing member for stopping the upper needle bed base is provided on the upper needle bed supporting member and the upper needle bed base is supported above the lower needle bed by the upper needle bed supporting member. With this arrangement, the upper needle bed is to be supported on the needle bed base by the needle plate of the lower needle bed. Since the needle plates of the lower needle bed are provided with pitches having a clearance enough to keep bolt insert spacings of the fixing means with respect to the widthwise of knitting of the knitting machine, the upper needle bed base is to be supported from the bottom with extremely high density to prevent an occurrence of the situation in which the central portion is hung down by the weight of the needle bed itself to curve the bed itself.

Next, another embodiment of the present invention which can always maintain an angle formed by the upper and lower needle beds will be described with reference to the drawings.

Figure 14:
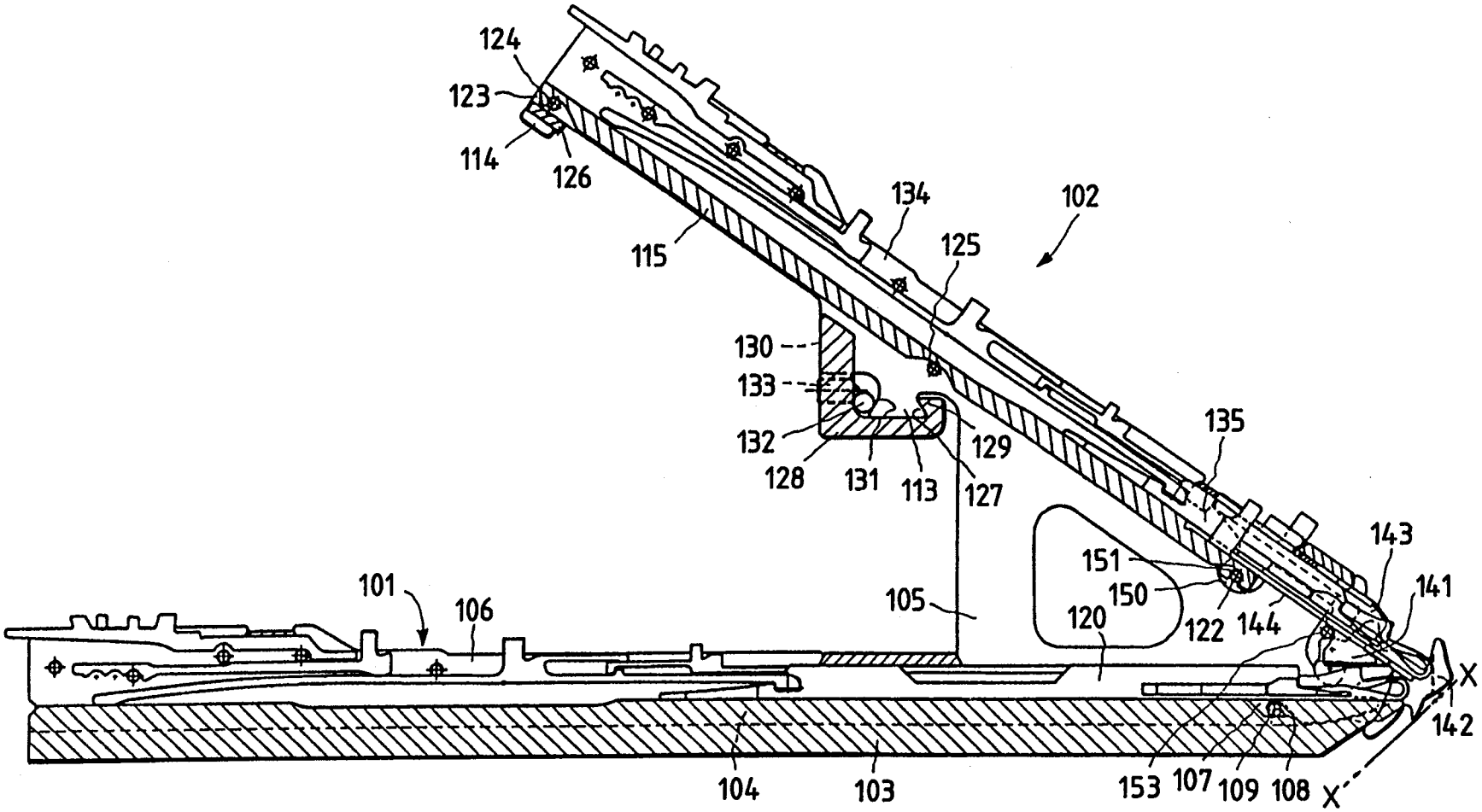
FIG. 14 is a schematic side view of the whole structure of another embodiment, showing only one side of a center line.

FIG. 14 shows an example in which a lower needle bed 101 arranged in the form of an inverted V-shape symmetrically to left and right and an upper needle bed 102 arranged in the form of an inverted V-shape symmetrically to left and right thereabove are cut by a center line X—X, thus showing the left half thereof.

Figures 15A, 15B:
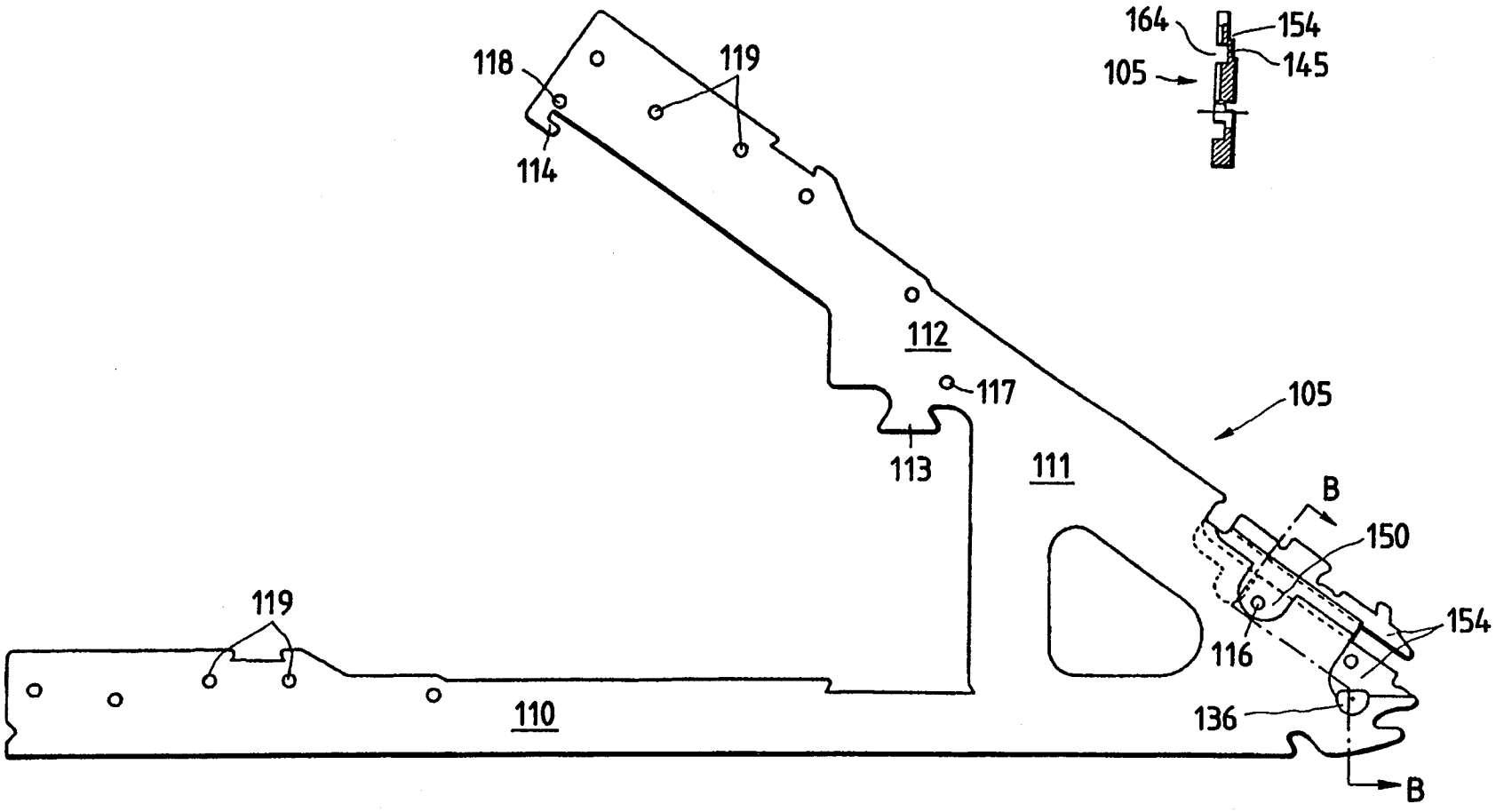
FIG. 15*a* is a side view of a needle plate.
FIG. 15*b* is a sectional view taken on line B—B of FIG. 2B.
Figure 16:
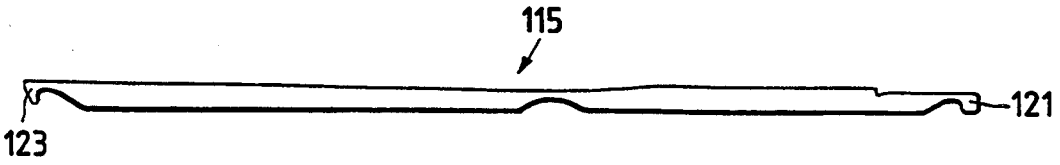
FIG. 16 is a side view of a needle plate spacer.

In the lower needle bed 101, needle plates 105 are inserted and fitted in plural rows of needle plate grooves 104 provided on a needle bed base 103 to form a needle groove 106 between the needle plates 105, both of which are fixed, for example, by passing a wire 109 through notches 107 and 108 provided in the needle bed groove base 103 and the needle plate 105. The needle plate 105 is a plate-like member composed of a lower needle groove wall 110 extending from a head to a tail of the lower needle bed 101, an extension portion 111 extending above the head, and an upper needle groove wall 112 reaching an upper level of the lower needle groove wall 110 extending rearward, as shown in FIG. 15. A dove tail 113 and a hook 114 to serve as a fixing member when the needle plates 105 are juxtaposed are projected downwardly at the lower portion of the upper needle groove wall portion 112. The needle plate 105 is provided with wire insert holes 116, 117 and 118 for stopping a needle plate spacer 115 and wire insert holes 119 for stopping upper and lower needles a jack, etc.

A plurality of the needle plates 105 are inserted into the needle plate grooves 104 of the lower needle bed base 103 to fix the lower needle bed base 103 and the needle plates 105 as mentioned above to form the needle groove 106 between the needle plates 105 and 105. A lower needle 120 is slidably inserted into the needle groove 106.

Figure 17:
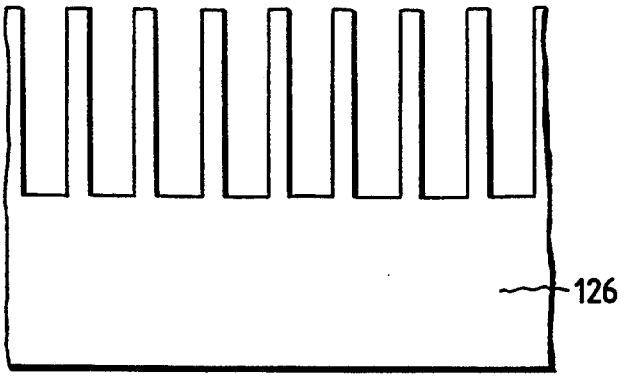
FIG. 17 is a plan view of a continuous ] -shaped comb.
Figure 18:
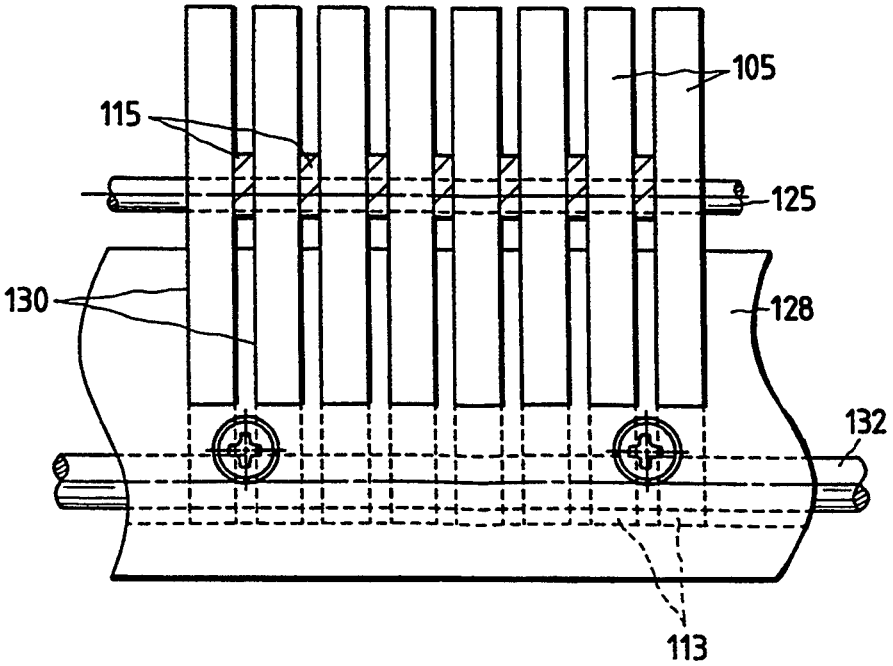
FIG. 18 is a front view of a beam fixing portion.

The upper needle bed 102 is provided above the lower needle bed 101 in the following procedure. As described above, the needle plates 105 are fitted in the needle plate grooves 104 provided in row in the needle bed base 103 of the lower needle bed 101, fixed by the wire 109 and caulked at the end together with the needle bed base 103. A needle plate spacer 115 is provided within a clearance between the upper needle groove walls 112 adjacent to each other of the juxtaposed needle plates 105. The needle plate spacer 115 has a hook 121 at the extreme end being stopped at a wire 122 inserted into a wire insert hole 116 of the needle plate 105. A hook 123 provided at the tail end is stopped at a wire 124 inserted into a wire insert hole 118 of the needle plate 105, and the needle plate spacer 115 is held between the needle plates 105 and 105 in the state where the central portion is placed on a wire 125 inserted into a wire insert hole 117. A continuous comb 126 is fitted in the hook 114 at the tail end of the needle plates 105 and 105 (see FIG. 17). A pawl 129 of a beam 128 having an L-shape in section is stopped at one inclined surface 127 of the dove tail 113 projected at the lower portion of the upper needle groove wall 112, the needle plates 105 are fitted in comb-like clearances 130 provided in a riser portion of the beam 128, a wire 132 is interposed between the inclined surface 131 of the dove tail 113 and the riser portion, and the wire 132 is threadedly mounted at suitable intervals and tightened by a screw 133 whereby a spacing between the needle plates 105 and 105 is maintained accurately to constitute the upper needle bed 102. A needle groove 134 of the upper needle bed 102 is formed between the needle plates 105 and 105, and an upper needle 135 is inserted therein. The needle plate 105 is provided with a sinker supporting hole 136 for rockably supporting a sinker 142 which will be described later.

In the upper needle bed 102, the needle spacer 115 is not extended to the neighbourhood of the head of the needle plate 105. A sinker spacer 141, a sinker 142, a sinker jack 143, a knockover bit 144, etc. are provided from the extreme end of the needle spacer 115 to a position opposed to the head of the lower needle bed 101. The details therefor will be described with reference to FIGS. 14 and 18 to 23.

The sinker spacer 141 is positioned at a shoulder 145 (see FIG. **15*b*) provided on the head of the upper needle groove wall 112 of the needle plate 105. The sinker spacer 141 (FIG. 23) has an inverted U-shaped wire insert notch 146 at the lower portion of the tail, an engaging recess 148 into which is inserted a strap 147 at the upper edge, and a bended element 149 for holding the lower needle 120 at the end edge extending downwardly of the head. The sinker spacer 141 is positioned at an enlarged shoulder 150 (see FIG. 14) in which the wire insert notch 146 of the tail is provided in the upper needle groove wall 112 and engaged with a wire 151 inserted into a wire insert hole 116 ranging the needle plates 105, and a depressed portion 152 at the lower portion of the head is engaged with a wire 153 similar to the wire 151*b* and secured to the upper needle groove wall 112**.

Figure 19:
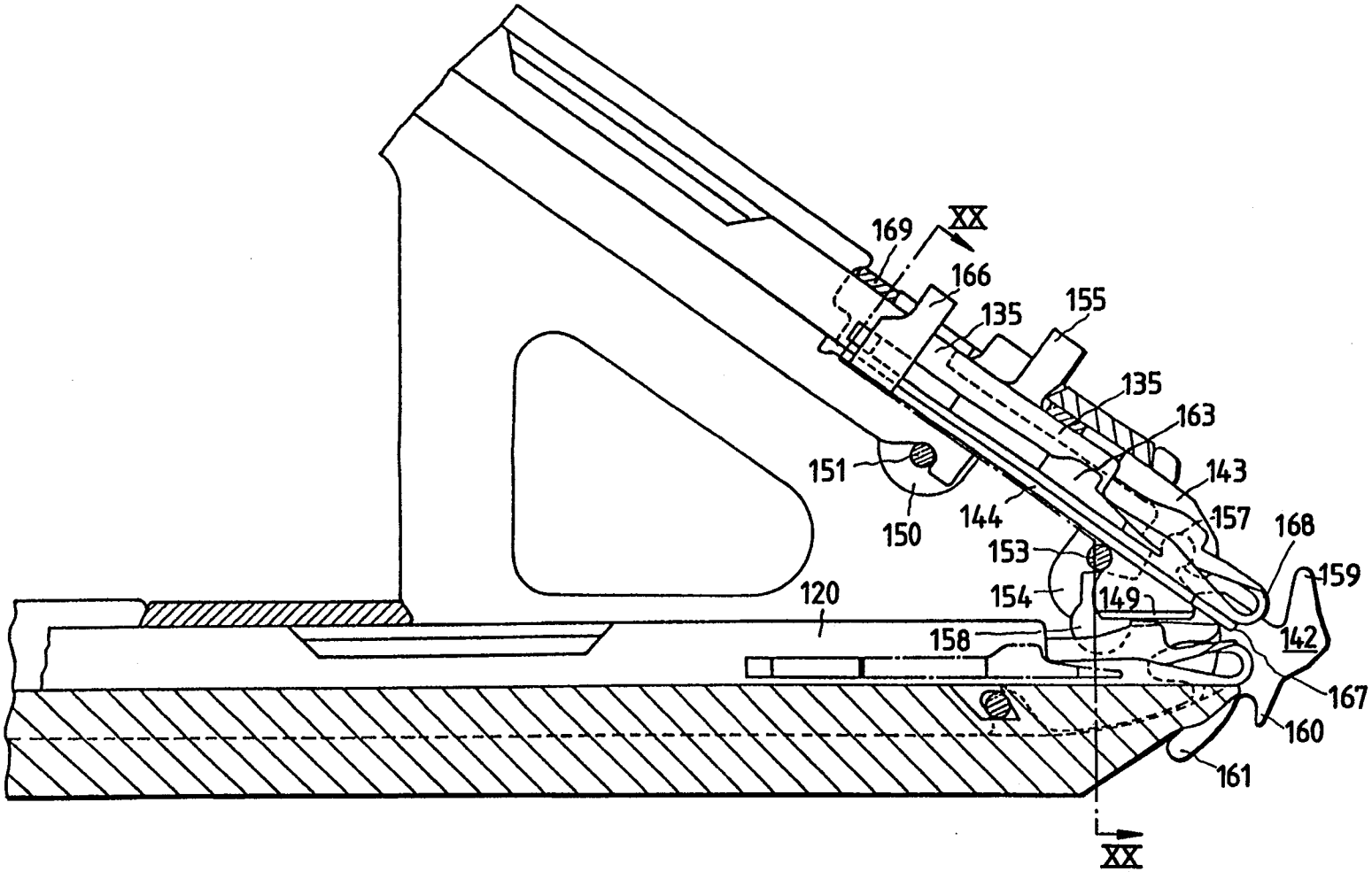
FIG. 19 is a sectional view taken on line XIX—XIX of FIG. 20.
Figure 21A:
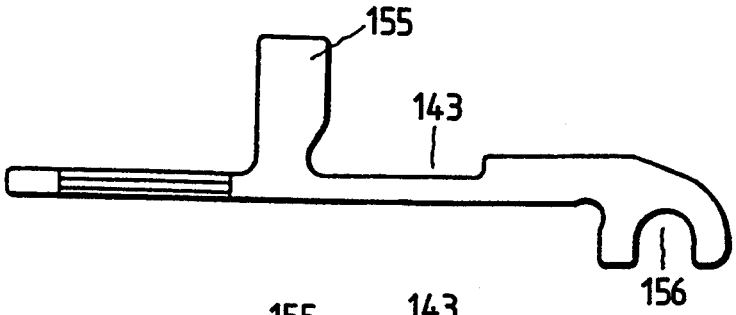
FIGS. 21*a* and 21*b* show a sinker jack, FIG. 21*a* being a side view, and FIG. 21*b* being a bottom view.
Figure 21B:
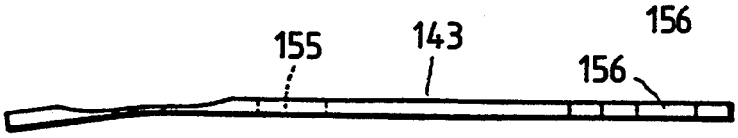
Figure 22:
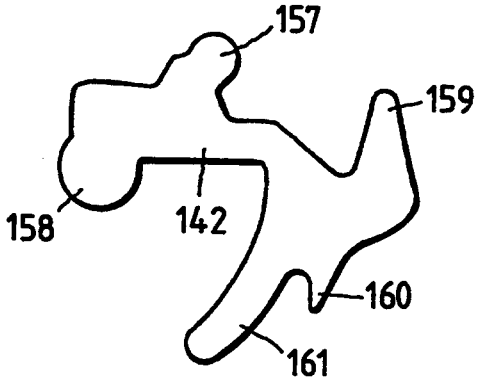
FIG. 22 is a side view of a sinker jack.
Figure 23:
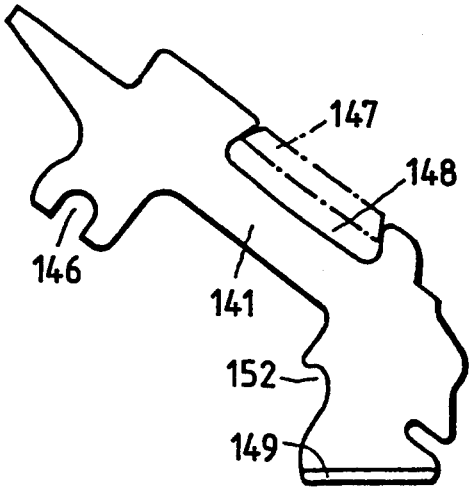
FIG. 23 is a side view of a sinker spacer.

By securement of the sinker spacer 141 to the upper needle groove wall 112, a clearance is formed between the sinker spacer 141 and the top of the upper needle groove wall 112 by a top shoulder 154 (FIG. **15*b*) of the upper needle groove wall 112, and the sinker jack 143 is inserted therein (FIG. 19). The shoulder 154 extends to the extreme end of the head of the needle plate 105, and the sinker 142 described later is fitted in said extreme end of the head. The sinker jack 143 is in the form of an elongated plate as shown in FIG. 21, in which a thin portion in the vicinity of the tail is bent so as not be carelessly moved as a result of a sliding resistance produced when the sinker jack 143 is inserted into the clearance formed by the shoulder 154. A butt 155 and a downward engaging concave 156 are formed in the upper portion and the head, respectively. The engaging recess 156 is engaged with an engaging convex 157 provided on the upper edge of the sinker 142. Similar to the sinker jack 143, the sinker 142 is also inserted into the same clearance formed by the shoulder 154 at the extreme end of the head of the needle plate 105, and a rockable shaft 158 provided on the tail is fitted in a sinker supporting hole 136 provided in the head of the needle plate 105 and bored in contact with a shoulder at the extreme end of the head continuous to the top shoulder 154 to rockably support the sinker 142. The sinker 142 has angular portions 159, 160 and 161** having a sinker loop in a vertical direction of the head.

Figure 20:
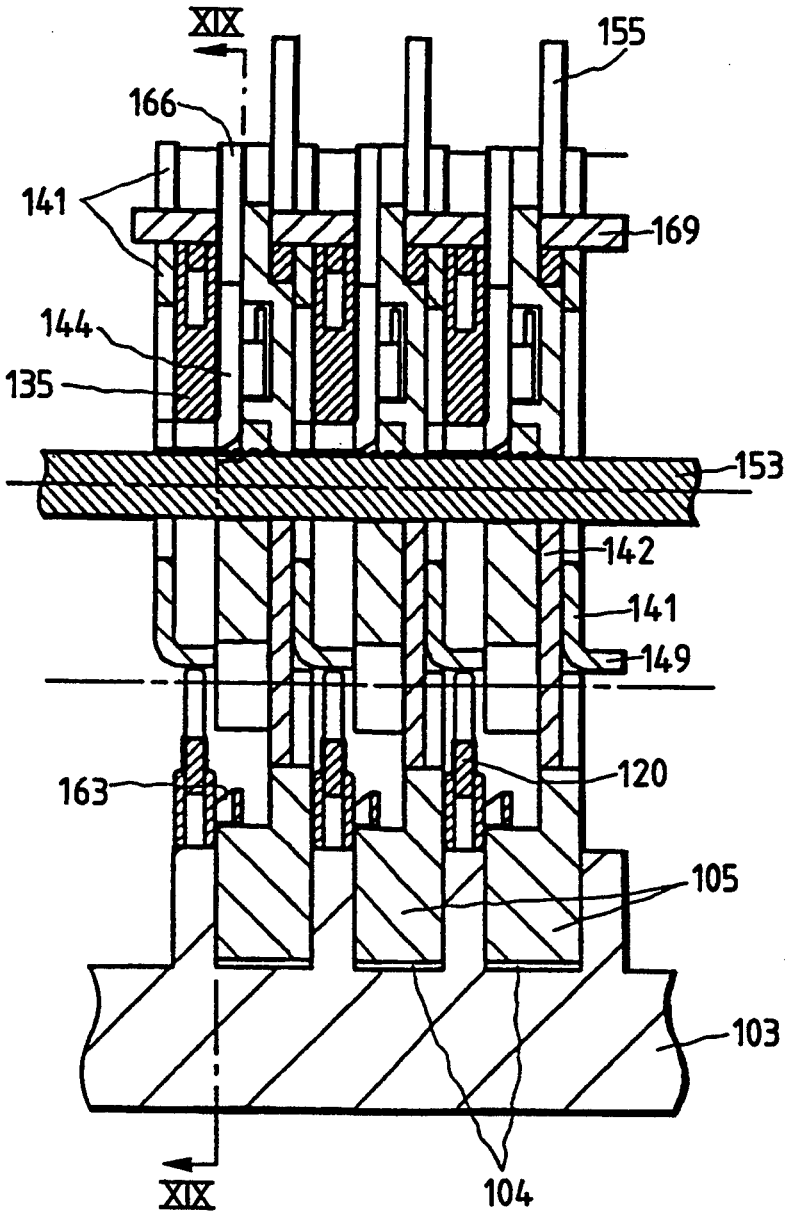
FIG. 20 is a sectional view taken on line XX—XX of FIG. 19.

A guide recess 164 into which is moved and slidably moved a loop transfer blade 163 of the upper needle 135 is provided in the side of the upper needle groove wall 112 of the needle plate 105 opposite to the shoulder 145, and the knockover bit 144 is slidably provided on the guide recess 164 side (FIG. **15*b* and FIG. 21) in the state where the wires 151 and 153 are placed thereon as shown in FIG. 20. The knockover bit 144 has a butt 166 at the tail of a flat plate-like shank 165 with the upper needle 135 placed thereon, and a square loop keep 167 at the head. A hook 168 of the upper needle 135 is positioned above the loop keep 167. A cam of a carriage not shown comes into contact with the butt 166 of the knockover bit 144 to enable forward and backward movement along the upper needle 135. The butt 166 of the knockover bit 144 and the butt 155 of the sinker jack 143 are fitted into the clearance of the upper needle groove wall 112 with comb-like needle plate spacers 169** juxtaposed so as to accurately hold their position to accurately maintain the spacing therebetween.

In the knitting operation of the knitting machine according to this embodiment of the present invention, the needles of both the beds 101 and 102 are operated by cams (not shown) of carriages corresponding to the lower needle bed 101 and the upper needle bed 102. In the upper needle bed 102, the knockover bit 144 together with the upper needle 135 are moved forward and backward according to the operation of the lower needle 120 to prevent the lower needle 120 from being impeded in forward and backward movement thereof.

Thus, the needle plates fitted in the needle plate grooves provided in plural rows on the lower needle bed base are extended upwardly to form the upper needle groove wall, the needle plate spacer is held between the needle plates of the upper needle groove wall, and the upper needle bed is constituted by the upper groove wall and the needle plate spacer. With this arrangement, the upper needle bed and the lower needle bed become integral with the needle plates to support the upper needle bed. Therefore, an angle formed by the upper and lower needle beds is constant when assembled, and the angle need not be adjusted and the angle is not varied during use. Since the upper needle bed is integral with the lower needle bed over the whole width of the knitting machine, it is possible to prevent an occurrence of the situation wherein a flexure is generated in the upper needle bed by being pressed by the carriage, or an occurrence of the situation wherein the central portion is hung down by the weight of the needle bed itself to curve the bed itself.

What is claimed is:

1. A flat knitting machine comprising:

upper and lower angularly opposed needle beds (1,2), each having a head portion for supporting a plurality of knitting needles and an opposite tail portion and a central portion between said head and tail portions, said lower needle bed (1) having a plurality of grooves (5) spaced therealong, a plurality of needle plates (3A) positioned each within one of the plurality of grooves (5) and having a needle guide portion (10) and a support (12) extending upwardly from said lower needle bed (1) wherein said upper needle bed is positioned on the support (12) at said central portion thereof, and means for securing said upper needle bed (2) to the support (12), wherein said upper and lower needle beds (1,2) are maintained in an angular relation.

2. The flat knitting machine set forth in claim 1 wherein said means for securing said upper needle bed comprises a wedge member on a bottom surface of said upper needle bed (1) having outwardly flared front and rear ends (24,25), and fixing means on the support (12) for engaging said front and rear ends (24,25) of said wedge member.

3. The flat knitting machine set forth in claim 2 wherein said fixing means comprises an upper support surface and a front support surface forming an angled notch with said upper support surface to receive the flared front end (24) of said wedge member, a stop member (26) having a threaded opening therethrough and an end (27) for engaging the flared rear end (25) of said wedge member, a beam member (14) extending into an opening in the support and having a threaded opening, and screw threaded means (29) received in the threaded opening in said stop member (26), extending through an opening in the support (12) and threaded into the threaded opening in said beam member for clamping said wedge member to the support.

4. A flat knitting machine comprising a lower needle bed (101) having a head portion at one end for supporting a plurality of knitting needles, an opposite tail portion and a plurality of grooves (104) spaced therealong, a plurality of needle plates (105) positioned each within one of the plurality of grooves (104), each said needle plate (105) having a lower needle groove wall (110), an upward extension (111) at the head portion thereof and an upper needle groove wall (112) extending from the upward extension (111) toward the tail portion, a plurality of needle plate spacers (115) positioned alternately between said needle plates (105), wherein the upper needle groove walls (112) of each said plurality of needle plates (105) and the plurality of needle plate spacers (115) form an upper needle bed (102) angularly disposed to said lower needle bed (101) for supporting a plurality of knitting needles thereon.

5. The flat knitting machine set forth in claim 4 comprising hook means (114) at the tail portion of each needle groove wall (112) to secure a tail portion of each said needle plate spacers (115), means (124) to secure each said needle plate spacer (115) to each of said needle plates (105), a wedge member (113) extending downward from each needle groove wall (112) adjacent the upward extension (111), and an L-shaped beam member (128) extending between said upper and lower needle beds (101,102) having a plurality of spaced openings (130) at an upper portion thereof to receive said needle groove walls (112) and an angled groove to receive said wedge member (113), and means (132) to secure said wedge member (113) to said beam member (128).

* * * * *